US011060703B2

(12) United States Patent
Jones

(10) Patent No.: US 11,060,703 B2
(45) Date of Patent: Jul. 13, 2021

(54) LIGHT REFLECTORS AND METHODS

(71) Applicant: Maile Ledford Jones, Arvada, CO (US)

(72) Inventor: Maile Ledford Jones, Arvada, CO (US)

( * ) Notice: Subject to any disclaimer, the term of this patent is extended or adjusted under 35 U.S.C. 154(b) by 115 days.

(21) Appl. No.: 16/236,537

(22) Filed: Dec. 30, 2018

(65) Prior Publication Data

US 2019/0178474 A1 Jun. 13, 2019

Related U.S. Application Data

(63) Continuation-in-part of application No. 15/598,267, filed on May 17, 2017, now abandoned, and a continuation-in-part of application No. 14/869,557, filed on Sep. 29, 2015, now abandoned.

(51) Int. Cl.

| | |
|---|---|
| ***F21V 17/16*** | (2006.01) |
| ***F21V 7/24*** | (2018.01) |
| ***F21V 17/10*** | (2006.01) |
| ***F21V 7/05*** | (2006.01) |
| ***F21V 17/06*** | (2006.01) |
| ***F21V 17/04*** | (2006.01) |
| *F21Y 115/10* | (2016.01) |

(52) U.S. Cl.

CPC ..... *F21V 17/16* (2013.01); *F21V 7/05* (2013.01); *F21V 7/24* (2018.02); *F21V 17/04* (2013.01); *F21V 17/06* (2013.01); *F21V 17/105* (2013.01); *F21Y 2115/10* (2016.08)

(58) Field of Classification Search

CPC ..... F21V 7/05; F21V 17/16

See application file for complete search history.

(56) References Cited

U.S. PATENT DOCUMENTS

| | | | | | |
|---|---|---|---|---|---|
| 1,286,287 | A | * | 12/1918 | Glenn | A61B 1/24 600/241 |
| 1,502,617 | A | | 7/1924 | William | |
| 1,740,488 | A | | 12/1929 | Wesley | |
| 1,974,077 | A | * | 9/1934 | Lynch | F21V 13/10 362/300 |
| 1,998,088 | A | | 4/1935 | Langdon | |
| 3,755,668 | A | | 8/1973 | Moreschini | |
| 4,135,228 | A | * | 1/1979 | Lones | F21L 14/02 362/18 |
| 4,337,506 | A | * | 6/1982 | Terada | F21S 6/002 362/142 |

(Continued)

FOREIGN PATENT DOCUMENTS

| | | | |
|---|---|---|---|
| CN | 204218033 U | * | 3/2015 |
| CN | 205261360 U | * | 5/2016 |

*Primary Examiner* — Charlie Y Peng

(74) *Attorney, Agent, or Firm* — Elevated IP, LLC

(57) ABSTRACT

Lighting accessories that can be installed in existing luminaire assemblies, as reflectors, are disclosed. The accessories are configured for placement above or on the side of a light bulb, where they can reflect a portion of the light produced by the bulb, thereby redirecting light to a useful area, increasing total light output, and reducing energy consumption. For example, a light reflector disclosed herein may comprise a substantially planar body having at least one substantially straight edge and at least two curved edges and a clamp affixed to a portion of the substantially planar body distal to the at least one substantially straight edge.

20 Claims, 8 Drawing Sheets

(56) References Cited

U.S. PATENT DOCUMENTS

| | | | | | |
|---|---|---|---|---|---|
| 4,994,947 | A | | 2/1991 | Fesko | |
| 5,825,637 | A | * | 10/1998 | Chen | F21V 7/0008 362/417 |
| 5,921,662 | A | * | 7/1999 | Bruckner | F21V 11/00 362/292 |
| 9,010,948 | B2 | * | 4/2015 | Lee | G03B 15/06 362/18 |
| 2013/0170227 | A1 | * | 7/2013 | Chen | F21V 7/0075 362/343 |
| 2015/0362159 | A1 | * | 12/2015 | Ludyjan | F21V 19/04 362/277 |
| 2018/0080623 | A1 | | 3/2018 | Jones | |
| 2018/0337502 | A1 | | 11/2018 | Jones | |

* cited by examiner

LIGHT REFLECTORS AND METHODS

CROSS-REFERENCE TO RELATED APPLICATIONS

This application is a continuation-in-part application claiming the benefit of and priority to U.S. patent application Ser. No. 14/869,557, filed Sep. 29, 2015, and U.S. patent application Ser. No. 15/598,267, filed May 17, 2017, both of which are hereby incorporated by reference in their entireties.

BACKGROUND

Many commercial light fixtures include built-in reflectors that are part of the fixture casing. Such reflectors reduce overall energy needs by concentrating light on areas where it is most beneficial. But when the scale of energy usage decreases, as in residential use, few consumers consider the energy and monetary savings that could be achieved with reflectors. And for those who do recognize the benefits of conserving electricity, there are relatively few options for after-market reflectors that can be installed in existing lighting fixtures.

The following patents disclose reflectors with specialized purposes, but they do not address general residential needs. U.S. Pat. No. 1,502,617 discloses a cone-shaped, radially fluted reflector having flexible fingers for gripping a bulb, such as an automobile headlight. U.S. Pat. No. 3,755,668 discloses a cupped reflector for rotating around a circumference of a hanging work light.

SUMMARY

Lighting accessories that can be installed in existing luminaire assemblies, such as ceiling luminaires, wall luminaires, standing lamps, refrigerators, metal light fixtures and other fixtures, are disclosed. The accessories are configured for placement above or on the side of a light bulb, where they can reflect a portion of the light produced by the bulb, thereby redirecting light to a useful area, increasing total light output, and reducing energy consumption.

The present reflectors may be used with a light bulb (bulb series A, B, C, G, P, RP) in a luminaire assembly, sized accordingly to bulb series and bulb shapes, containing any percentage of reflecting ability, comprised of any composition of materials that are ideal and suitable.

For example, a reflector may sit on approximately one-quarter of the side of a light bulb, or on one-third of a side or a light bulb, or on one-half of the circumference of a light bulb. The reflector may be sized in the proportion of 6.5 mm by 9.5 mm in relation to a type T3 Coil series bulb. The reflector may have the circumference of 14.25 inches in relation to a type T3 LED bulb. Generally, the reflector is sized proportionately as specified to each of the light bulb series sizes and bulb shapes: A, B, C, F, G, PS, RP, S, Compact Fluorescent Coils, Compact Fluorescent Plug In Lamps. In an embodiment, the reflector, in use, is in proximity of nearly touching the bulb or touching the bulb.

In an aspect, a light reflector comprises a substantially planar body having at least one substantially straight edge and at least two curved edges and a clamp affixed to a portion of the substantially planar body distal to the at least one substantially straight edge.

In an embodiment, a substantially planar body of a light reflector is two-dimensional and substantially rigid.

In an embodiment, a substantially planar body of a light reflector comprises one or more reflective materials. The one or more reflective materials may be selected from the group consisting of coilzak, aluminum, silver, gold, platinum, titanium, Mylar and combinations thereof.

In an embodiment, a substantially planar body of a light reflector is characterized by a thickness of less than 0.05 inches, or less than 0.04 inches, or less than 0.035 inches, or less than 0.03 inches, or less than 0.025 inches. In an embodiment, a substantially planar body of a light reflector is characterized by a height between 6 inches and 3 inches, or between 5.5 inches and 3.5 inches, or between 5 inches and 4 inches, or between 5 inches and 4 4/16 inches. In an embodiment, a light reflector comprises a substantially planar body with a height of 4 4/16 inches and a total height (including a clamp) of 5.5 inches. In an embodiment, a substantially planar body is characterized by a lateral dimension between 6 inches and 3 inches, or between 5.5 inches and 3.5 inches, or between 5 inches and 4 inches, or between 4.5 inches and 4 inches.

In an embodiment, a clamp of a light reflector is integral with the substantially planar body or modular with respect to the substantially planar body. In an embodiment, the clamp is selected from the group consisting of a C-clamp, a screw clamp, a twist clamp, a spring clamp, a hose clamp and combinations thereof. In an embodiment, the clamp is substantially planar in an open configuration (FIG. 8). In an embodiment, a clamp may comprise the same material as the substantially planar body and/or a different material. In an embodiment, a clamp comprises a flexible material, such as fabric or elastic.

In an embodiment, a light reflector further comprises a magnet disposed on a backside of the substantially planar body.

In an embodiment, a light reflector further comprises one or more magnets on or within the clamp. For example, in an embodiment, a clamp comprises first and second arms comprising first and second magnets oriented to attract one another when the clamp is in a closed configuration.

In an aspect, a method of using a light reflector comprises providing a light reflector, positioning the substantially planar body of the light reflector between a light source and an interior surface of a lighting fixture and securing the clamp of the light reflector to a light bulb receiver or socket of the lighting fixture.

BRIEF DESCRIPTION OF THE DRAWINGS

Illustrative embodiments of the present invention are described in detail below with reference to the attached drawings, wherein.

DETAILED DESCRIPTION

In general, the terms and phrases used herein have their art-recognized meaning, which can be found by reference to standard texts, journal references and contexts known to those skilled in the art. The following definitions are provided to clarify their specific use in the context of this description.

A "device" is a combination of components operably connected to produce one or more desired functions.

A "component" is used broadly to refer to an individual part of a device.

Figure 3:
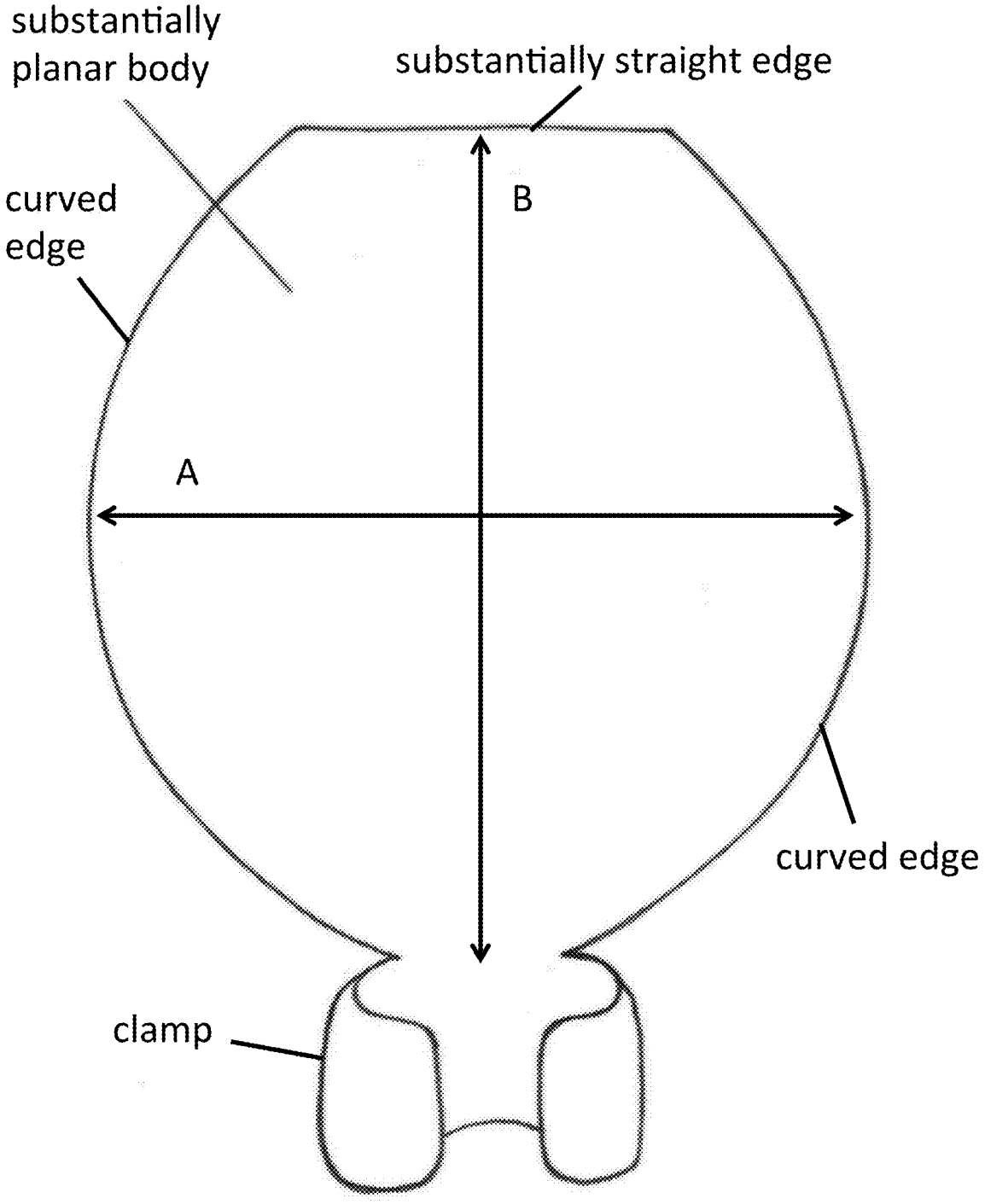
FIG. 3 shows a schematic of a light reflector comprising a clamp, according to an embodiment.

As used herein, a "lateral dimension" refers to a dimension at the widest point of the substantially planar body, generally illustrated as the dimension shown by arrow A of FIG. 3.

As used herein, a "height" of a substantially planar body is generally illustrated as a dimension along arrow B of FIG. 3.

The terms "direct and indirect" describe the actions or physical positions of one component relative to another component. For example, a component that "directly" acts upon or touches another component does so without intervention from an intermediary. Contrarily, a component that "indirectly" acts upon or touches another component does so through an intermediary (e.g., a third component).

"Proximal" and "distal" refer to the relative positions of two or more objects, planes or surfaces. For example, an object that is close in space to a reference point relative to the position of another object is considered proximal to the reference point, whereas an object that is further away in space from a reference point relative to the position of another object is considered distal to the reference point.

"Integral" refers to materials or components that are touching or connected throughout in an unbroken sequence.

Figure 1:
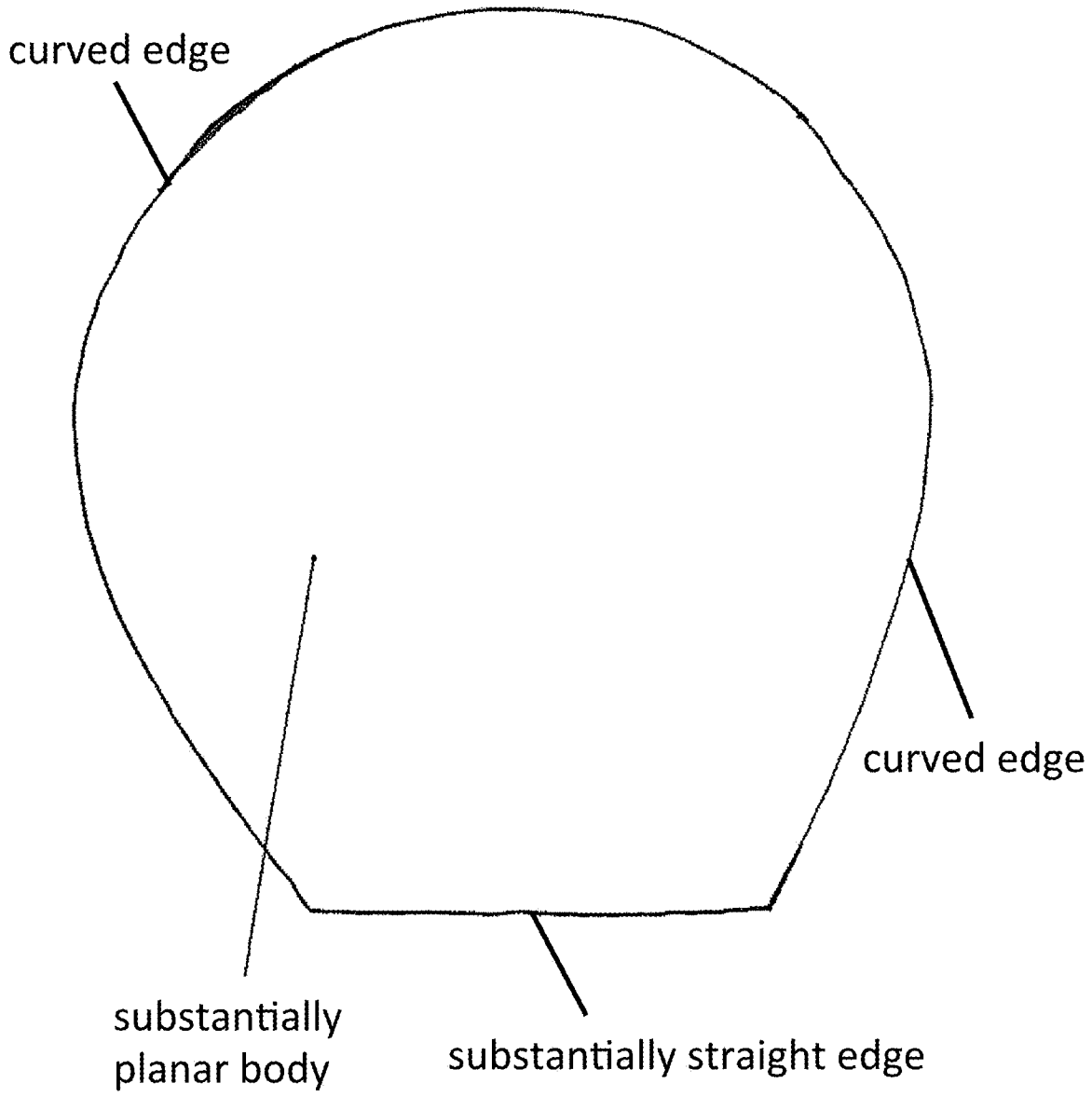
FIG. 1 shows a schematic of a front face of a light reflector comprising a substantially planar body, according to an embodiment.
Figure 2:
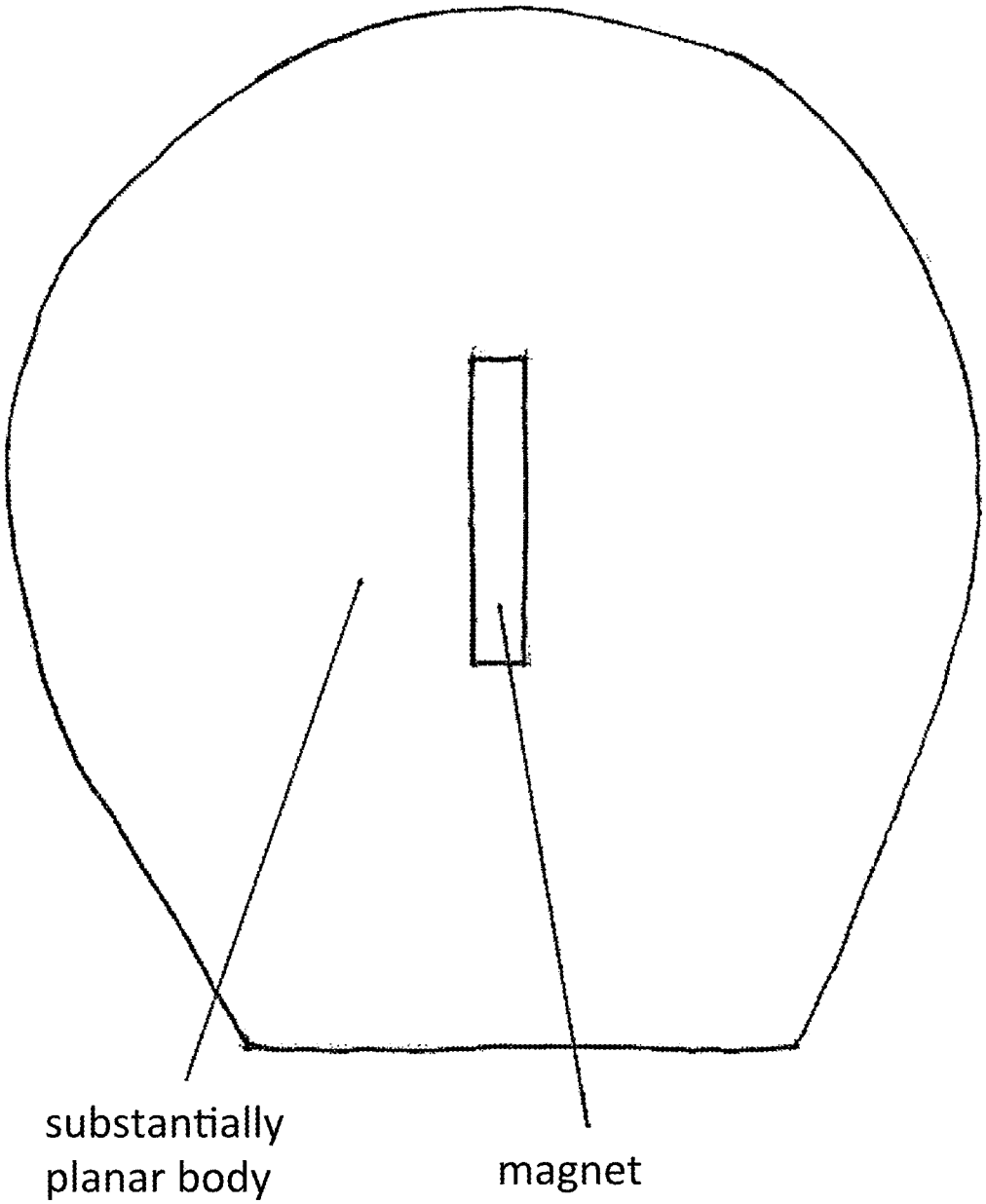
FIG. 2 shows a schematic of a back face of the light reflector of FIG. 1 comprising an optional magnet for adhering to a metallic light fixture, according to an embodiment.

FIG. 1 shows a schematic of a front face of a light reflector comprising a substantially planar body having at least one substantially straight edge and at least two curved edges, according to an embodiment. As shown, the first and second curved edges directly contact one another to form a contiguous edge. FIG. 2 shows a schematic of a back face of the light reflector of FIG. 1 comprising an optional magnet for adhering the reflector to a metallic light fixture, according to an embodiment.

FIG. 3 shows a schematic of a light reflector comprising a substantially planar body having at least one substantially straight edge, at least two curved edges and a clamp, according to an embodiment. As shown, the clamp is integral or unitary with the substantially planar body (i.e., no brace or adhesive is used to join the body and the clamp).

Figure 4:
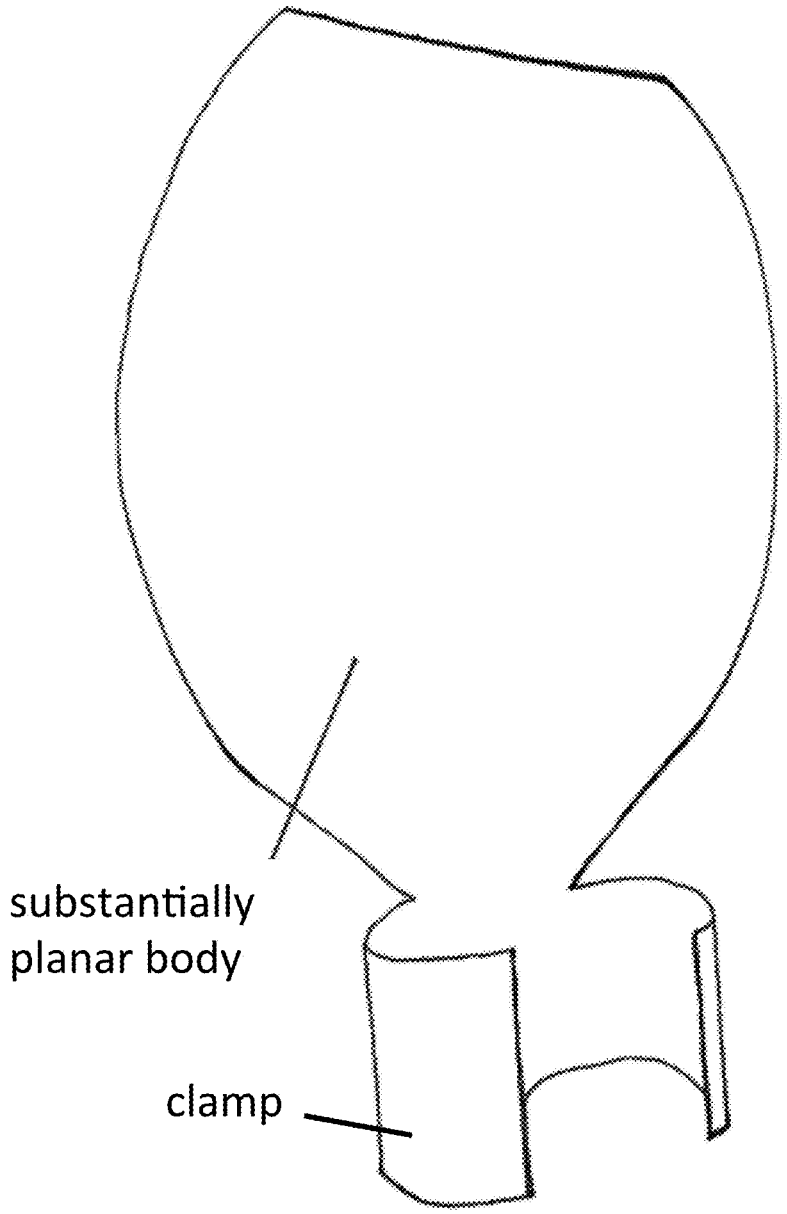
FIG. 4 shows a schematic of a light reflector comprising a clamp, according to an embodiment.

FIG. 4 shows a schematic of a light reflector comprising a substantially planar body having at least one substantially straight edge, at least two curved edges and a clamp, according to an embodiment. As shown, the clamp is integral or unitary with the substantially planar body (i.e., no brace or adhesive is used to join the body and the clamp).

Figure 5:
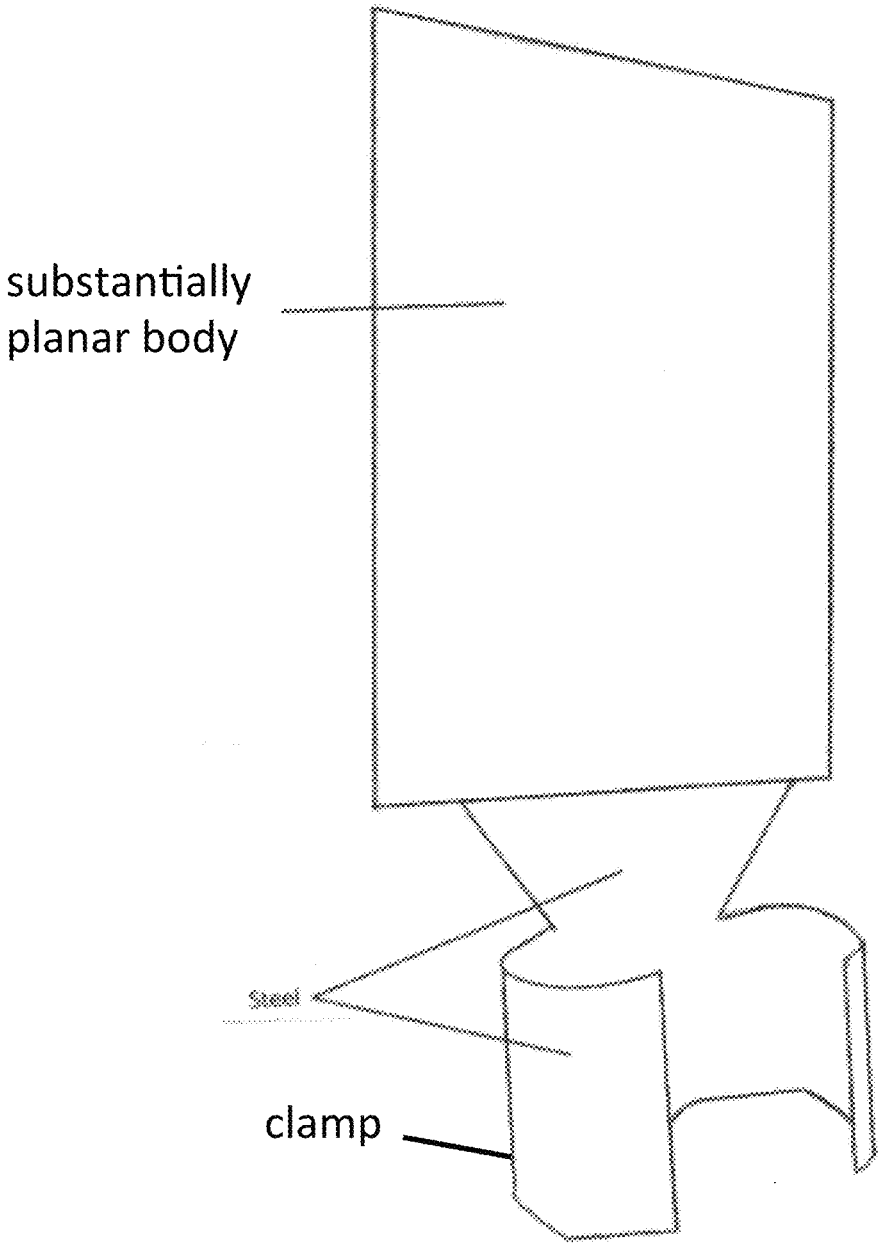
FIG. 5, FIG. 6 and FIG. 7 show front, top and back views, respectively, of a light reflector having a substantially planar body with a square or rectangular shape and a clamp, according to an embodiment.
Figure 6:
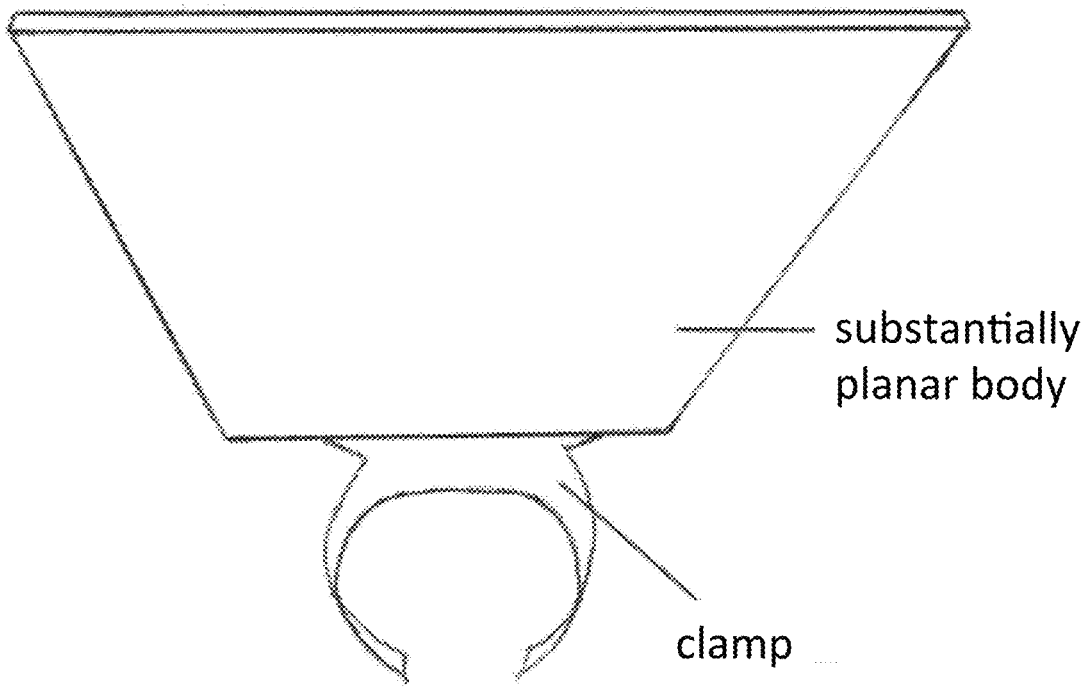
Figure 7:
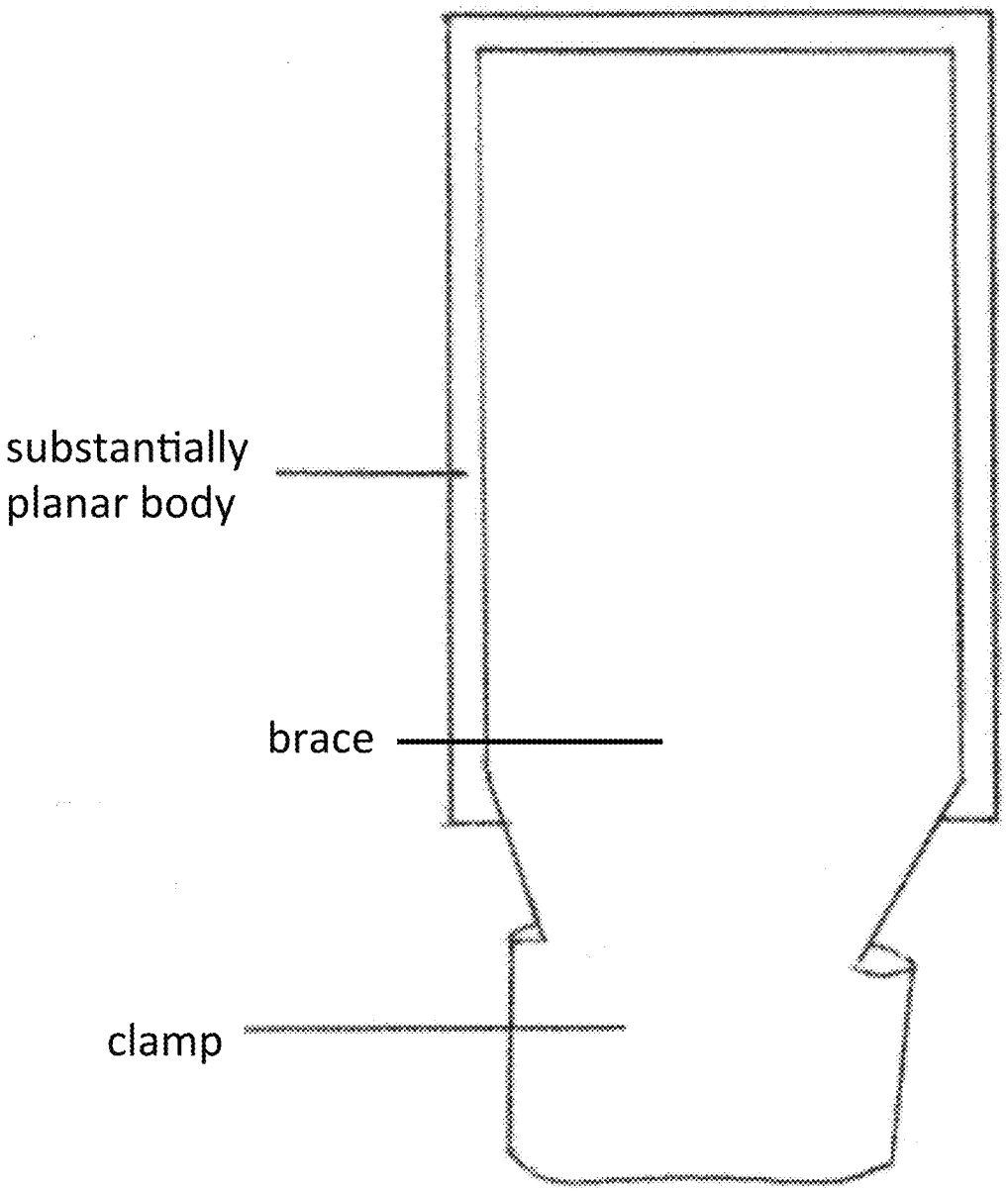
Figure 8:
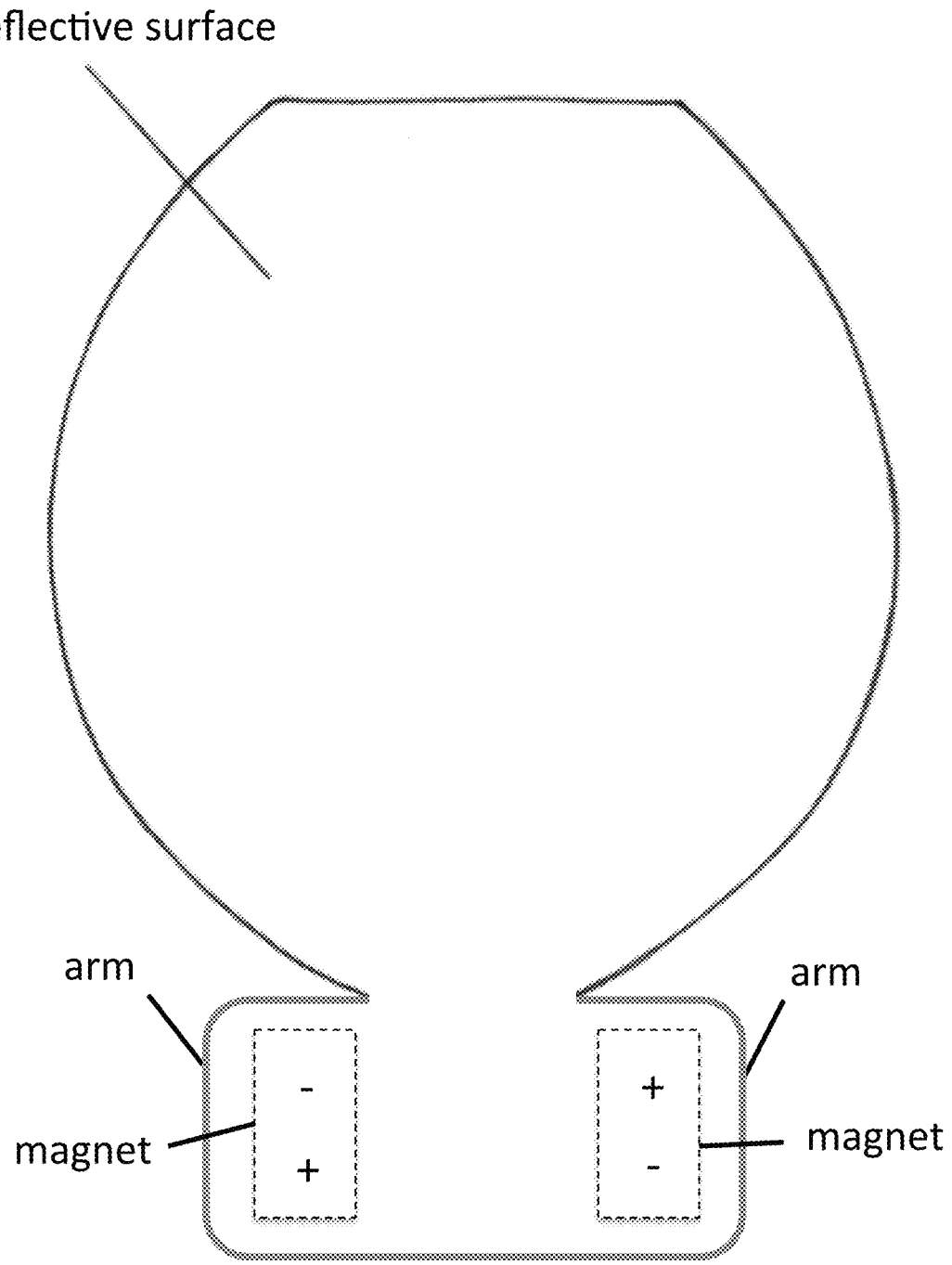
FIG. 8 shows a schematic of a light reflector comprising a clamp in an open configuration, according to an embodiment.

FIG. 5, FIG. 6 and FIG. 7 show front, top and back views, respectively, of a light reflector having a substantially planar body with a square or rectangular shape and a clamp, according to an embodiment. The perspective shown in FIG. 6 illustrates a brace extending from the clamp to support the substantially planar, reflective body. The brace and clamp may, for example, be made of steel.

The devices, components and methods disclosed herein are further illustrated by the following Examples. These Examples are for illustrative purposes only and are not intended to limit the invention.

EXAMPLE 1

In an embodiment, a reflector is made of a flat galvanized steel sheet and a mirror. The steel is cut into a rectangular shape the same width and height of a cfl light bulb. Then sections are cut out so it follows the shape of the bulb and leaves room for the bottom area to wrap around the light socket. The bottom is cut shorter so that it extends three-quarters of the way down the light socket and wraps around the light socket. A rectangular glass mirror that is 6½ mm by 9½ mm is glued onto the steel with JB Weld glue. The reflector is designed to sit just above the light bulb reflecting more downward light.

In a typical ceiling light, the testing cfl light bulb has a lux reading of 920, measured a foot away from the bulb. After the light reflector is fastened to the light socket, the light bulb and reflector have readings of 1010, 1200, and 1300 lux from 3 different angles, measured a foot away from the bulb. Intensity of light at a desired location has been increased by up to 41%, which creates greater lighting efficiency.

EXAMPLE 2

In an embodiment, a reflector is made of a flat Coilzak sheet and a thin magnet. The Coilzak is cut into a rounded shape larger than the width and height of a standard LED light bulb. Then a section is cut flat at the bottom so that it fits in a fixture with the light socket at the bottom. A thin magnet is glued onto the Coilzak with JB Weld glue. The reflector is designed to sit just above the light bulb increasing the intensity of downward light.

In a typical ceiling light, the reflector and tested LED light bulb produce a reading with a lux light meter of 32% more light than with the LED light bulb alone. Intensity of light emitted by the lamp in a desired direction has been increased by up to 32%, which creates greater lighting efficiency.

All references cited throughout this application, for example patent documents including issued or granted patents or equivalents; patent application publications; and non-patent literature documents or other source material are hereby incorporated by reference herein in their entireties, as though individually incorporated by reference.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a magnet" includes a plurality of such magnets and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements or limitation or limitations which is/are not specifically disclosed herein.

All art-known functional equivalents of materials and methods are intended to be included in this disclosure. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

What is claimed is:

1. A device comprising:

a light reflector including:

a substantially planar body comprising a reflective surface, the reflective surface having at least one substantially straight edge and at least two curved edges; and a clamp affixed to a portion of the substantially planar body distal to the at least one substantially straight edge, wherein the clamp opens and closes around an axis perpendicular to the substantially straight edge;

the substantially planar body of the light reflector positioned between a light source and an interior surface of a lighting fixture; and the clamp of the light reflector secured to a light bulb receiver of the lighting fixture.

2. The device of claim 1, wherein the reflective surface comprises one or more reflective materials selected from the group consisting of coilzak, aluminum, silver, gold, platinum, titanium, Mylar and combinations thereof.

3. The device of claim 1, wherein the substantially planar body is characterized by a thickness less than or equal to 0.025 inches.

4. The device of claim 1, wherein the substantially planar body has a lateral dimension less than or equal to 4.5 inches.

5. The device of claim 1, wherein the clamp is integral with the substantially planar body.

6. The device of claim 1, wherein the clamp is selected from the group consisting of a C-clamp, a screw clamp, a twist clamp, a spring clamp, a hose clamp and combinations thereof.

7. The device of claim 1, wherein the clamp is substantially planar in an open configuration.

8. The device of claim 1 further comprising a magnet disposed on a backside of the substantially planar body.

9. The device of claim 1 further comprising one or more magnets on or within the clamp.

10. The device of claim 9, wherein the clamp comprises first and second arms comprising first and second magnets oriented to attract one another when the clamp is in a closed configuration.

11. A method of using a light reflector comprising:

providing the light reflector of claim 1;

positioning the substantially planar body of the light reflector between a light source and an interior surface of a lighting fixture; and securing the clamp of the light reflector to a light bulb receiver of the lighting fixture.

12. The method of claim 11, wherein the reflective surface comprises one or more reflective materials selected from the group consisting of coilzak, aluminum, silver, gold, platinum, titanium, Mylar and combinations thereof.

13. The method of claim 11, wherein the substantially planar body has a lateral dimension less than or equal to 4.5 inches.

14. The method of claim 11, wherein the clamp is integral with the substantially planar body.

15. The method of claim 11, wherein the clamp is selected from the group consisting of a C-clamp, a screw clamp, a twist clamp, a spring clamp, a hose clamp and combinations thereof.

16. The method of claim 11, wherein the clamp is substantially planar in an open configuration.

17. The method of claim 11 further comprising positioning one or more magnets on or within the clamp.

18. The method of claim 17, wherein the clamp comprises first and second arms comprising first and second magnets oriented to attract one another when the clamp is in a closed configuration.

19. The device of claim 1, wherein the clamp comprises fabric or elastic.

20. The method of claim 11, wherein the clamp comprises fabric or elastic.

* * * * *